US006155321A

United States Patent [19]

Bindschedler et al.

[11] Patent Number: 6,155,321

[45] Date of Patent: Dec. 5, 2000

[54] MACHINE FOR LAYING A THERMOWELDABLE COVERING STRIP

[75] Inventors: Pierre Etienne Bindschedler, Obernai, France; Denis Cartier, St-Edmond, Canada

[73] Assignee: Soprema (Societe Anonyme), Strasbourg, France

[21] Appl. No.: 09/118,858

[22] Filed: Jul. 20, 1998

[30] Foreign Application Priority Data

Jul. 18, 1997 [FR] France ..... 97 09324

[51] Int. Cl.[7] ..... B32B 31/00

[52] U.S. Cl. ..... 156/497; 156/499; 156/544; 156/574; 431/181

[58] Field of Search ..... 156/497, 499, 156/544, 574; 431/8, 9, 183, 182, 181

[56] References Cited

U.S. PATENT DOCUMENTS

| | | | |
|---|---|---|---|
| 4,440,588 | 4/1984 | Stevenson et al. | 156/157 |
| 4,855,004 | 8/1989 | Chitjian | 156/359 |
| 5,051,148 | 9/1991 | Resch | 156/358 |
| 5,234,533 | 8/1993 | Neal | 156/497 |
| 5,827,054 | 10/1998 | Sarv et al. | 431/184 |

FOREIGN PATENT DOCUMENTS

| | | |
|---|---|---|
| 0 213 338 | 3/1987 | European Pat. Off. . |
| 2 583 449 | 12/1986 | France . |
| 920539 | 3/1963 | United Kingdom . |
| 2 133 527 | 7/1984 | United Kingdom . |

*Primary Examiner*—Richard Crispino
*Assistant Examiner*—Sue A. Purvis
*Attorney, Agent, or Firm*—Young & Thompson

[57] ABSTRACT

A machine for laying a thermoweldable strip covering includes a movable support chassis provided with a support for a strip of rolled-up covering and for the unrolling and application of this strip, and at least one unit for the production of hot air, prolonged by an ejection nozzle provided with an outlet opening in the form of a transverse slot and whose outlet flow is directed toward the thermoweldable undersurface of the covering strip immediately prior to its application onto the support to be covered.

10 Claims, 3 Drawing Sheets

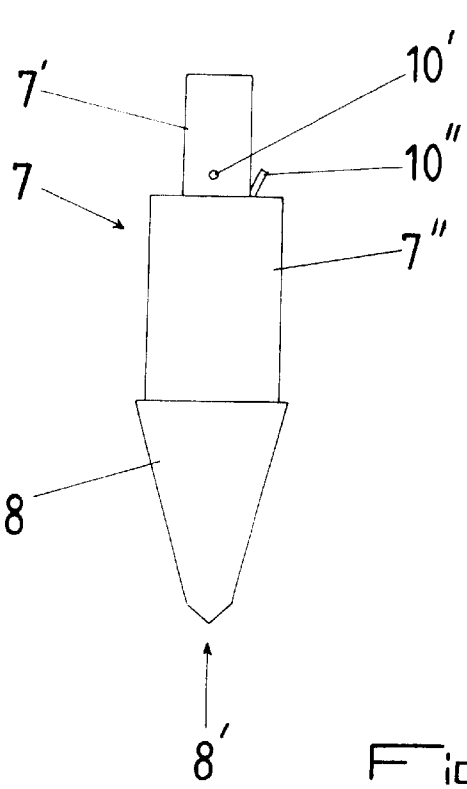
Fig-2B
Fig-2
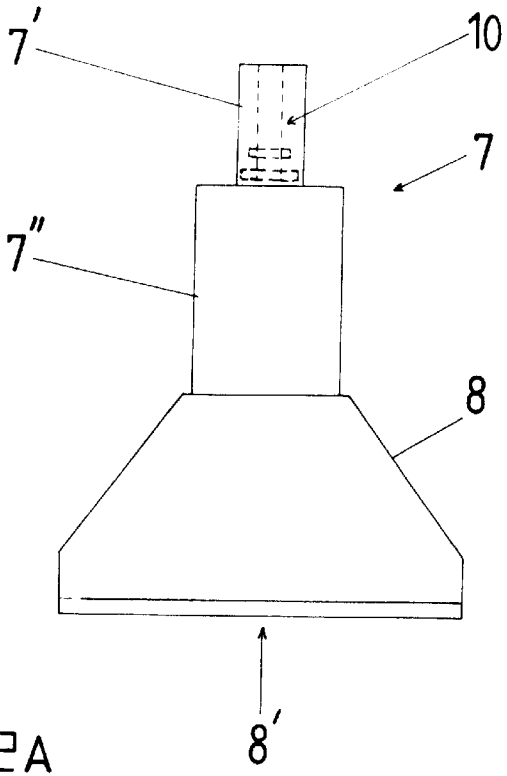
Fig-2A

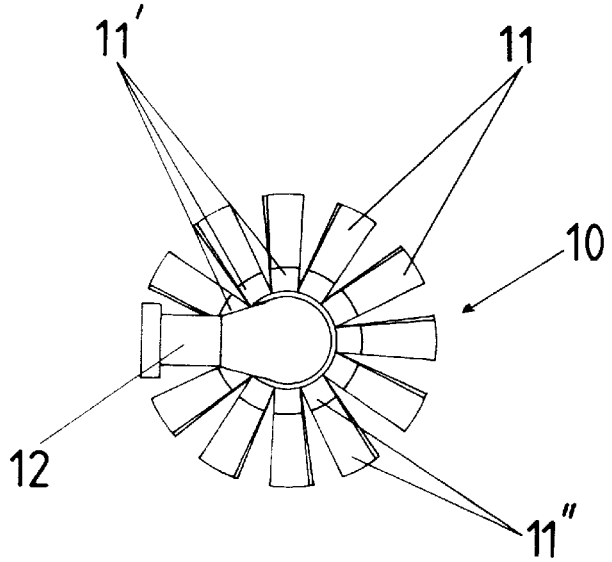
Fig-3B
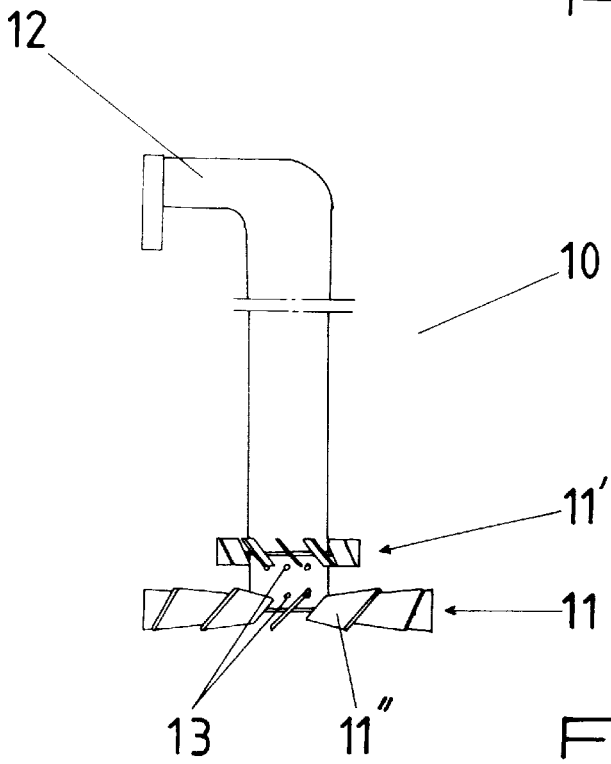
Fig-3A
Fig-3

MACHINE FOR LAYING A THERMOWELDABLE COVERING STRIP

This application corresponds to French application 97 09324 of Jul. 18, 1997, the disclosure of which is incorporated herein by reference.

BACKGROUND OF THE INVENTION

The present invention relates to the field of construction, civil engineering and public works, more particularly the covering of large surfaces by means of strips of sealing, insulating and/or protective material, and has for its object a movable machine for laying a thermoweldable covering strip, preferably self-propelled.

1. Description of the Related Art

There are already known machines of the mentioned type in which the strips of thermoweldable covering are subjected to indirect heating means before their application to the support to be covered.

These machines, known particularly from FR-A-2 689 151 and FR-A-2 718 164, comprise more particularly a heating cylinder enclosing a bath of heated oil, the covering strip circulating over this cylinder with its thermoweldable surface in intimate contact with the surface of the latter immediately before its application to the support to be covered.

However, these machines have numerous drawbacks, among others of which could be cited, on the one hand, a leveling, a tearing off and/or a carbonization of the binder of the thermoweldable surface of the covering, on the other hand, a deposit of binder on the heating cylinder requiring repeated cleaning operations and, finally, a limited speed of laying, given the type of indirect heating, by contact, that is used.

Similar drawbacks have been encountered for machines of the mentioned type, in which the heating cylinder integrates an exposed flame heating means, which is, because of this fact, more delicate and risky in operation.

Moreover, the heated cylinder machines with an oil bath require circuits for circulation of fluid and for heating that are complex and bulky, which cannot be used to heat the support prior to its application and require providing a type of supplemental heating means to carry out, as the case may be, this preparation of the support.

However, such a preliminary operation of preparation of the support constitutes an element favoring the adhesion of the applied strip.

2. Summary of the Invention

The present invention has particularly for its object to overcome at least certain of the mentioned drawbacks.

To this end, the invention has for its object a machine for laying a thermoweldable strip covering, preferably self-propelled, comprising a movable support chassis provided with means for support, for unrolling and for application of at least one strip of rolled-up covering, characterized in that it comprises at least one unit for the production of hot air prolonged by an ejection nozzle provided with an outlet opening in the form of a transversely extending slot and of which the outlet flow is directed toward the thermoweldable undersurface of the strip covering immediately before its application to the support to be covered.

BRIEF DESCRIPTION OF THE DRAWINGS

The invention will be better understood from the following description, which relates to a preferred embodiment, given by way of non-limiting example, and explained with reference to the accompanying schematic drawings, in which:

FIGS. 2A and 2B are respectively front and side elevational views of a unit for the production of hot air forming a part of the production unit of hot air shown in FIGS. 2A and 2B; and FIGS. 3A and 3B are respectively side elevational and top plan views of the burner.

DESCRIPTION OF THE PREFERRED EMBODIMENTS

Figure 1:
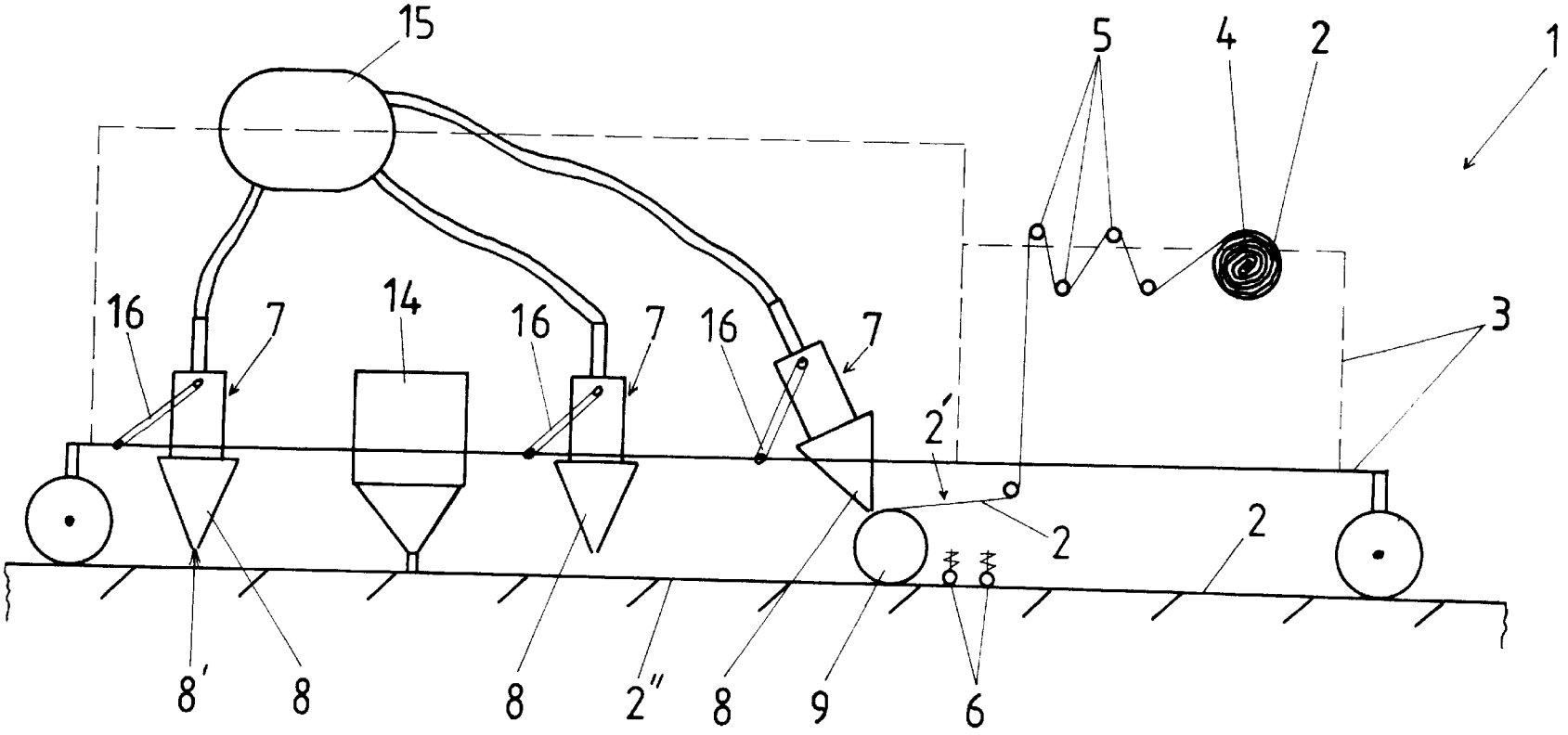
FIG. 1 is a partial side elevational view of a machine according to the invention.

As shown in FIG. 1 of the accompanying drawings, the self-propelled machine 1 for laying a thermoweldable strip covering 2, comprises a movable support chassis 3 provided with support means 4, unrolling means 5 and laying means 6, 9 for at least one rolled-up strip of covering 2.

This machine 1 could comprise drive means and means for the supply of electrical energy for feeding the various actuating and drive members and could be provided with a control panel and/or remote control means (not shown in FIG. 1).

Said machine 1 could also comprise a storage for rolls of strip covering 2 and a station for joining successive strips 2 to each other (not shown).

According to the invention, said machine 1 moreover comprises at least one unit 7 for the production of hot air prolonged by an ejection nozzle 8 provided with an outlet opening 8' in the form of a slot that extends transversely and whose outlet flow is directed toward the thermoweldable undersurface 2' of the covering strip 2 immediately before its application to the support 2" to be covered.

This heating means, whilst requiring no complicated installation and having no risk during handling, permits a large direct heat transfer, without carbonization nor physical contact, as well as flexible and instantaneous control of the heat applied.

According to a first characteristic of the invention, shown in FIGS. 1 and 2 of the accompanying drawings, the ejection nozzle 8 of each unit 7 for the production of hot air is substantially in the form of a transversely profiled wedge, the outlet opening 8' being adapted to be positioned at an adjustable distance from the surface of an applicator roller 9 over which circulates the covering strip 2, with its thermoweldable undersurface 2' exposed, immediately before its application to the support 2".

This particular shape of ejection nozzle 8 permits channeling the air flow and shaping it for its ejection through the outlet slot 8' so as to produce a directional and homogeneous jet of hot air.

Moreover, the positional adjustment of the nozzle 8 permits the provision of the coverings with a layer of binder on the undersurface 2' which will be more or less thick, the distance between the opening 8' and the undersurface 2' depending on the speed of travel of the strip 2, on the thickness of the binder to be reheated, on the desired degree of reheating and on the heating performances of the unit 7 for the production of hot air in question.

It has been noted that a distance of about 0.5 to 5 cm, preferably comprised between 1 and 3 cm, gives optimum results.

According to one embodiment of the invention, each unit for the production of hot air can preferably comprise a chamber 7' for forming a gas/air mixture and for ignition, opening into a combustion chamber 7", said mixing and ignition chamber 7' being supplied with air under pressure in a quantity greater than stoichiometric and enclosing a burner 10 provided with means 11, 11' for mixing gas and air and prolonged downwardly by an ejection nozzle 8 (FIGS. 1, 2 and 3).

As shown in FIGS. 3A and 3B, the burner 10 has substantially a blade burner structure, formed by a conduit extending partially into the mixing and ignition chamber or for illumination 7', in the direction of the combustion chamber 7", supplied with a gas/air mixture at its end connected to a supply sleeve 12 and provided, at the level of its opposite free end directed toward the combustion chamber 7", with several radial perforations 13 and at least one crown 11, 11' formed by radial inclined blades 11".

According to a preferred modification of the invention, the radial perforations 13 are spaced uniformly about the cylinder circumference of the conduit in one or several rows, this or these latter being located between an upper blade crown 11' and a lower blade crown 11.

For a diameter of the conduit of the burner of the order of 4 cm, this latter could for example have about 30 to 40 perforations 13, each about 3 mm in diameter and spaced about two cylinder rows.

The upper crown of blades 11' is adapted to promote the gas/air mixture by creating turbulence in the air flow injected into the mixing and ignition chambers 7' and flowing about the conduit forming the body of the burner 10.

The lower blade crown 11 has, as it itself, the function of driving back upwardly at least a portion of the injected air, into the annular region into which open the perforations 13.

According to one characteristic of the invention, shown particularly in FIG. 3A of the accompanying drawings, the blades 11" of the upper crown 11' and those of the lower crown 11 are respectively aligned with each other two by two and have inclination angles a relative to the axis of the conduit, that are mutually opposed and comprised between about 25° and about 75°, preferably between 30° and 60°, the ratio of the lengths of the upper and lower blades 11" being comprised between about 3 and 5.

As also shown in FIGS. 3A and 3B of the accompanying drawings, the mixing and ignition chamber 7' has a cylindrical structure, the external diameter of the lower crown of blades 11 being substantially identical or slightly less than the internal diameter of said chamber 7', which gives rise to maximum back pressure of the injected air and a mixing and vigorous agitation of this latter with the gas ejected at the level of the perforations 13 (for example methane or propane, stored in liquid form in corresponding reservoirs carried by the machine 1).

The strip 7' for mixing and ignition is also provided, as shown in FIGS. 3, with a lighter 10' and a flame detector 10".

So as to permit preparation of the support 2" to be covered, by washing, a preheating and, as the case may be, a drying of this latter before laying the covering strip 2, each assembly of support means 4, 5, 6 and 9, and the unrolling means and the means for applying a rolled-up strip 2 of covering, is preceded by at least one unit for the production of hot air 7 prolonged by an injection nozzle 8 whose flow is directed onto the support 2" to be covered.

According to a supplemental characteristic of the invention, shown also in FIG. 1 of the accompanying drawings, said machine 1 can comprise, upstream of each support and unrolling and application means 4, 5, 6 and 9, a station for the deposition of a primary layer on the support 2', preceded and followed by a unit 7 for the production of hot air prolonged by an ejection nozzle 8.

The unit 7 preceding the station 14 in the direction of advance of the machine 1 will carry out, as indicated above, a preparation of the support 2" to be covered, whilst the unit 7 which follows said station 14 permits drying the primary layer applied on the support 2" before laying the covering.

It should be noted that the machine 1 comprising two assemblies of means 4, 5, 6 and 9, each preceded, as the case may be, with at least one production unit 7' and a station 14, could, as to the recited constituent elements, either have a structure that is symmetrical relative to a medial longitudinal plane, or have a structure that is symmetrical relative to a central point of symmetry.

In the first case, the two parallel alignments of the constituent elements 4, 5, 6, 7, 9 and 14 have orders of succession that are identical and the machine 1 could lay simultaneously and in parallel two strips 2 of covering, whilst in the second case said constituent elements 4, 5, 6, 7, 9 and 14 of the two alignments would have a reverse order of succession, permitting said machine 1 to proceed to lay a covering strip 2 in each of the two possible directions of longitudinal displacement for said machine 1.

In the two cases, this latter would comprise of course an assembly station for the longitudinal edges of the two covering strips 2 that are adjacent on the support 2".

Finally, as shown in FIG. 1 of the accompanying drawings, the different units 7 for production of hot air could be supplied by a single blower 15 and be supported on adjustable support arms 16, control means and means for adjustment of the air flow, of the injection pressure and of the gas/air support being provided for each of said units 7.

The machine according to the invention is particularly well adapted for laying strips of sealed covering in the field of civil engineering and public works, but also in the field of construction.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. A machine for laying a strip of thermoweldable covering, comprising:

a movable support chassis provided with means for supporting and unrolling and applying at least one strip of unrolled covering; and at least one unit (7) for the production of hot air, said unit communicating with an ejection nozzle (8) provided with an outlet opening (8') in the form of a transverse slot and whose outlet flow is adapted to be directed to an undersurface (2') of said strip covering (2) immediately prior to its application onto a support (2") to be covered, wherein the ejection nozzle (8) of each unit (7) for the production of hot air is substantially in the form of a transversely profiled wedge, the outlet opening (8') being adapted to be positioned at an adjustable distance from the surface of an applicator roller (9) or which the covering circulates as a strip, with its thermoweldable undersurface (2') exposed immediately before its application to the support (2").

2. Machine according to claim 1, wherein each production unit (7) for hot air comprises a gas/air mixing and ignition chamber (7') opening into a combustion chamber (7"), said mixing and ignition chamber (7") being supplied with air under pressure with a quantity greater than stoichiometric and enclosing a burner (10) provided with means (11, 11') for mixing gas/air and prolonged downwardly by an ejection nozzle (8).

3. Machine according to claim 2, wherein the burner (10) has substantially the structure of a burner with blades, comprised by a conduit extending partially into the mixing and ignition chamber (7') in the direction of the combustion chamber (7"), supplied with a mixture of gas and air at its end connected to a supply sleeve (12) and provided, at the level of its free opposite end directed toward the combustion chamber (7"), with several radial perforations (13) and at least one crown (11, 11') formed by inclined radial blades (11").

4. Machine according to claim 3, wherein the radial perforations (13) are distributed uniformly about the circular circumference of the conduit in at least one row, said at least one row being located between an upper crown of blades (11') and a lower crown of blades (11).

5. Machine according to claim 4, wherein the blades (11") of the upper crown (11') and the blades of the lower crown (11) are respectively aligned with each other two by two and have inclination angles ($\alpha$) relative to the axis of the conduit which are mutually opposed and comprised between about 25° and about 75°, the ratio of the lengths of said upper and lower blades (11") being comprised between about 3 and 5.

6. Machine according to claim 3, wherein the mixing and ignition chamber (7') has a cylindrical structure, the external diameter of the lower crown of blades (11) being no more than the same as the internal diameter of said chamber (7').

7. Machine according to claim 2, wherein each assembly (4, 5, 6, 9) of support means, unrolling means and application means of a covering strip (2) is preceded by at least one unit (7) for the production of hot air prolonged by an ejection nozzle (8) whose flow is directed onto the support (2") to be covered.

8. Machine according to claim 7, which further comprises, upstream of each assembly (4, 5, 6, 9) of support means, unrolling means and application means, a station (14) for depositing a primary layer on the support (2') preceded and followed by a unit (7) for the production of hot air prolonged by an ejection nozzle (8).

9. A machine for laying a strip of thermoweldable covering, comprising:

a movable support chassis provided with means for supporting and unrolling and applying at least one strip of unrolled covering;

at least one unit (7) for the production of hot air, said unit communicating with an ejection nozzle (8) provided with an outlet opening (8') in the form of a transverse slot and whose outlet flow is adapted to be directed to an undersurface (2') of said strip covering (2) immediately prior to its application onto a support (2") to be covered; and two assemblies of support means, unrolling means and means for laying a band of covering (2) disposed side by side in two parallel longitudinal alignments, at least one production unit (7) for hot air being associated with each of said assemblies.

10. A machine for laying a strip of thermoweldable covering, comprising:

a movable support chassis provided with means for supporting and unrolling and applying at least one strip of unrolled covering; and at least one unit (7) for the production of hot air, said unit communicating with an election nozzle (8) provided with an outlet opening (8') in the form of a transverse slot and whose outlet flow is adapted to be directed to an undersurface (2') of said strip covering (2) immediately prior to its appl*ication onto a support (2") to be covered, wherein different units (7) for the production of hot air are supplied by a single blower (15) and are supported by adjustable support arms (16), control means and adjustment means for the air flow, for the injection pressure being provided for each of said units (7).

* * * * *